US009579539B2

(12) United States Patent
Lin

(10) Patent No.: US 9,579,539 B2
(45) Date of Patent: Feb. 28, 2017

(54) COMPOUNDED FITNESS TRAINER

(71) Applicant: Fu-Hai Lin, Taichung (TW)

(72) Inventor: Fu-Hai Lin, Taichung (TW)

( * ) Notice: Subject to any disclaimer, the term of this patent is extended or adjusted under 35 U.S.C. 154(b) by 21 days.

(21) Appl. No.: 14/679,920

(22) Filed: Apr. 6, 2015

(65) Prior Publication Data

US 2016/0287933 A1 Oct. 6, 2016

(51) Int. Cl.
*A63B 22/00* (2006.01)
*A63B 22/20* (2006.01)

(52) U.S. Cl.
CPC ..... *A63B 22/203* (2013.01); *A63B 22/0048* (2013.01); *A63B 2022/0053* (2013.01)

(58) Field of Classification Search
USPC ..... 482/1–148
See application file for complete search history.

(56) References Cited

U.S. PATENT DOCUMENTS 2,825,563 A * 3/1958 Lawton ..... A63B 22/001 482/112
5,356,356 A * 10/1994 Hildebrandt ..... A63B 21/157 482/57
5,464,378 A * 11/1995 Yu ..... A63B 21/068 482/57
5,505,679 A * 4/1996 McBride ..... A63B 21/0083 482/112
5,611,758 A * 3/1997 Rodgers, Jr. ..... A63B 22/001 482/51
6,361,479 B1 * 3/2002 Hildebrandt ..... A63B 21/157 280/253
6,602,168 B2 * 8/2003 Duke ..... A63B 21/154 482/51
6,932,745 B1 * 8/2005 Ellis ..... A63B 22/0023 482/52
7,500,938 B2 * 3/2009 Fan ..... A63B 22/0076 482/72
7,713,176 B1 * 5/2010 Farney ..... A63B 21/154 482/52
7,846,074 B2 * 12/2010 Wu ..... A63B 21/155 434/60
8,113,996 B1 * 2/2012 Allen ..... A63B 21/0088 482/57
8,923,978 B1 * 12/2014 Hartman ..... A61N 1/36003 607/48
2013/0005546 A1 * 1/2013 Wang ..... A61H 1/0292 482/142

(Continued)

*Primary Examiner* — Stephen Crow
(74) *Attorney, Agent, or Firm* — Tracy M. Helms; Apex Juris, pllc

(57) ABSTRACT

A compounded fitness trainer, including a base, on which a loading device is pivoted; a pair of first driving bars pivoted on the base for swinging; a pair of second driving bars pivoted on the base for swinging; a pair of first linkages respectively pivoted on the second driving bars and opposite sides of the loading device; and a pair of second linkages respectively pivoted on the first driving bars and the first linkages wherein the first driving bars are moved by the second driving bars when the second driving bars are moved, and the second driving bars are moved by the first driving bars when the first driving bars are moved whereby moving the first driving bars and/or the second driving bars may train different muscles.

17 Claims, 8 Drawing Sheets

(56) References Cited

U.S. PATENT DOCUMENTS

| | | | | |
|---|---|---|---|---|
| 2013/0079200 | A1* | 3/2013 | Rahimi | A61H 1/0255<br>482/62 |
| 2013/0337984 | A1* | 12/2013 | Lung | A63B 21/0421<br>482/140 |

* cited by examiner

COMPOUNDED FITNESS TRAINER

BACKGROUND OF THE INVENTION

1. Technical Field

The present invention relates generally to a training machine, and more particularly to a compounded fitness trainer.

2. Description of Related Art

In modern life, lack of physical exercise causes musculoskeletal and cardiovascular problems. Prolonged, daily sitting on a chair causes people to become obese and may even cause scoliosis.

There are many training machines commercially available enabling people to exercise and train the muscles in their leisure time. Exercise enhances metabolism which promotes good health.

Conventional training machines are designed to simulate natural exercises, such as steppers, which are provided with two pedals to simulate stair stepping, and elliptical machines, which are provided with a flywheel and two pedals linked to the flywheel to simulate walking or two pedals moving on fixed rails (in a direction of forward and rearward or in a direction of inward and outward). Conventional training machine provides a single repeated exercise only, and users have to buy different kinds of training machines for different kinds of physical exercises. This is expensive and, furthermore, the training machines typically require a large space at home.

Conventional training machines are designed to train limited muscles, such as specific leg muscles or arm muscles. There is a lack of a training machine which could train the muscles of different body portions at the same time.

BRIEF SUMMARY OF THE INVENTION

The primary objective of the present invention is directed to a compounded fitness trainer, which provides two kinds of exercises for selection by a user to train different muscles.

In order to achieve the objective of the present invention, the present invention provides a compounded fitness trainer, including a base, on which a loading device is pivoted; a pair of first driving bars pivoted on the base, each of which is moved between a first position and a second position; a pair of second driving bars pivoted on the base, each of which is moved between a third position and a fourth position; a pair of first linkages respectively pivoted on the second driving bars and the loading device, wherein the first linkages respectively pivoted on opposite sides of the loading device; and a pair of second linkages respectively pivoted on the first driving bars and the first linkages.

The first driving bars are moved by the second driving bars when the second driving bars are moved, and the second driving bars are moved by the first driving bars when the first driving bars are moved.

The user may hold the first driving bars and put feet on the second driving bars to move the first driving bars and/or the second driving bars to thereby train different muscles.

BRIEF DESCRIPTION OF THE SEVERAL VIEWS OF THE DRAWINGS

The present invention will be best understood by referring to the following detailed description of some illustrative embodiments in conjunction with the accompanying drawings.

DETAILED DESCRIPTION OF THE INVENTION

Figure 1:
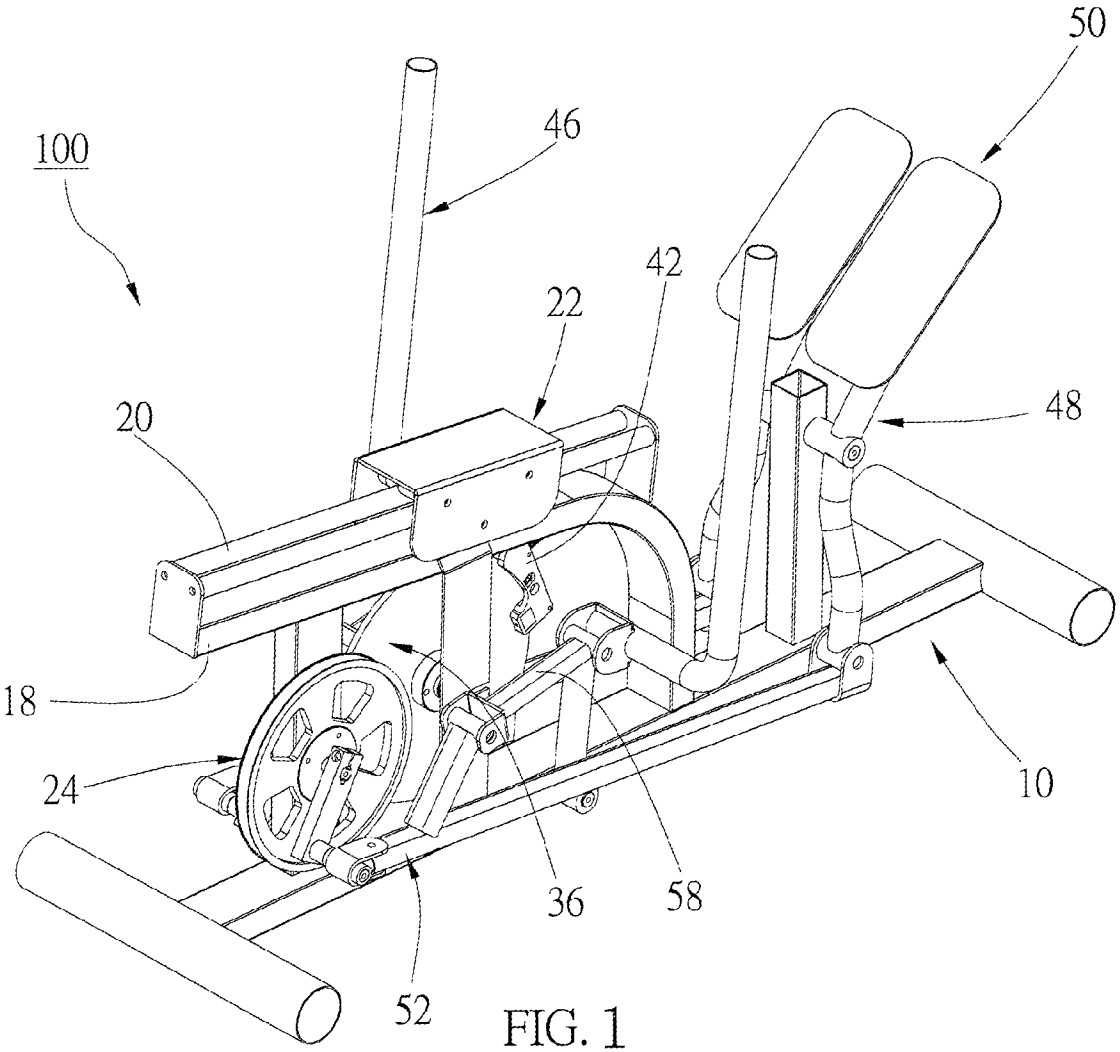
FIG. 1 is a perspective view of a first preferred embodiment of the present invention.
Figure 2:
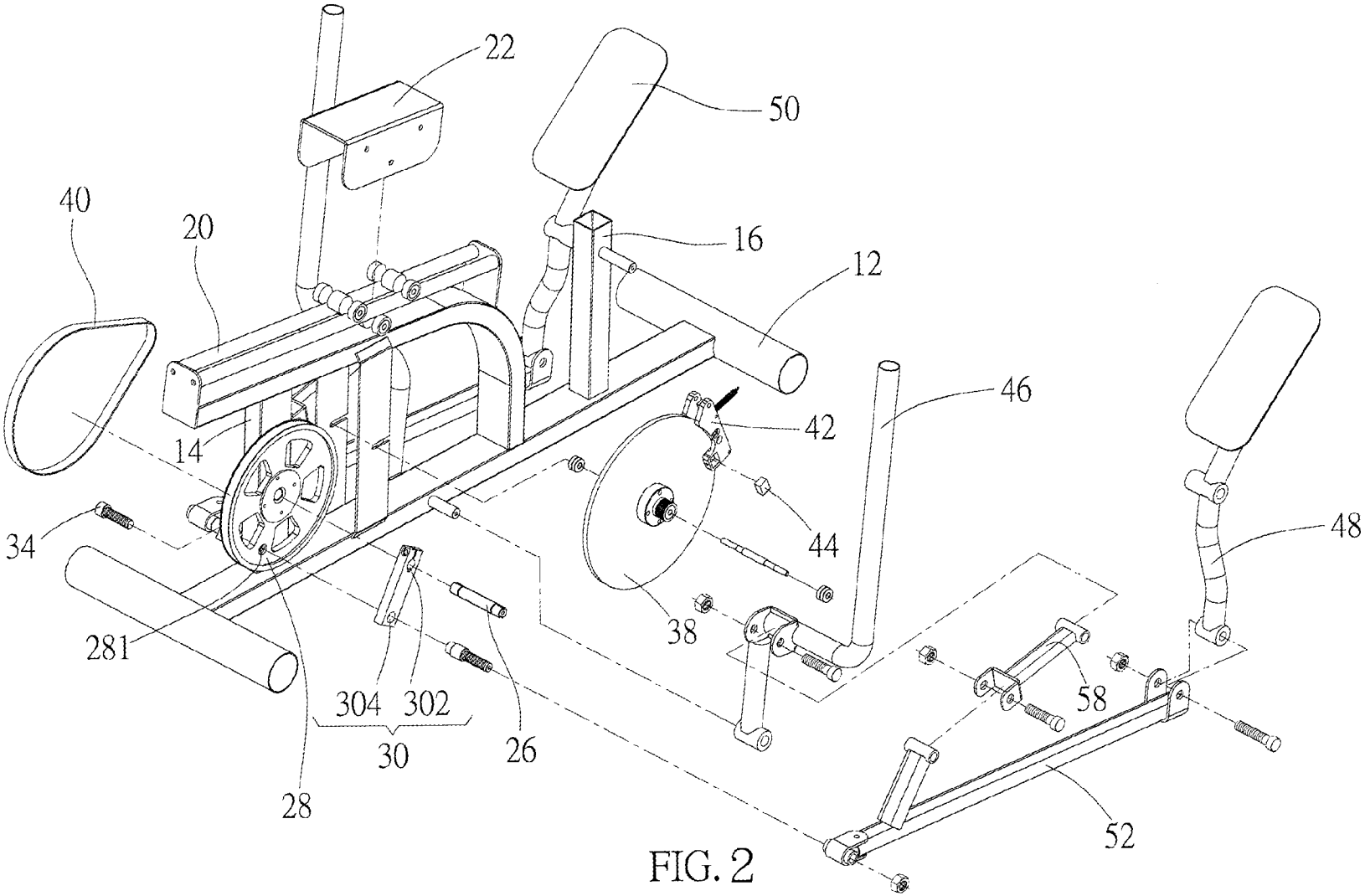
FIG. 2 is an exploded view of the first embodiment of the present application.
Figure 3:
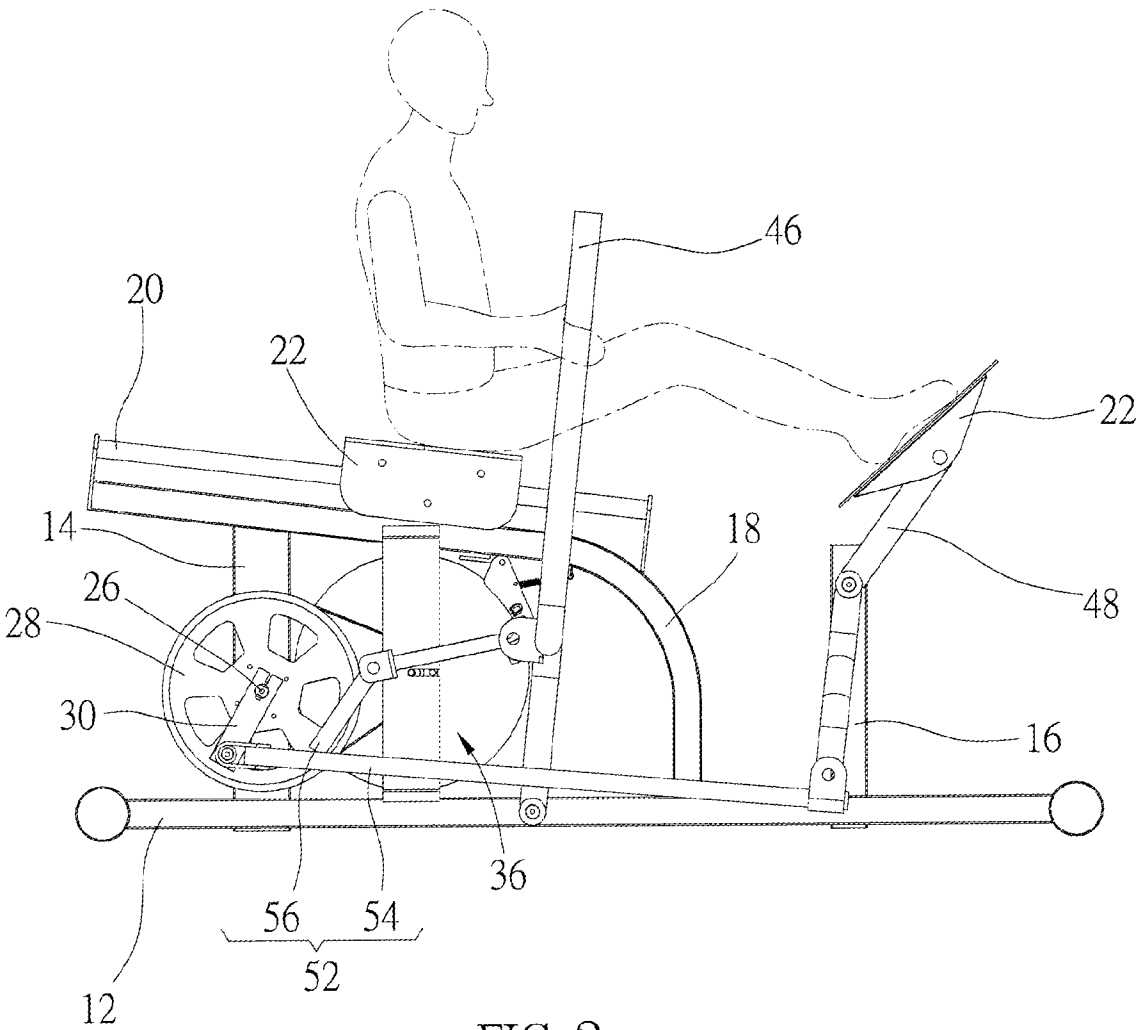
FIG. 3 is a left view of the first embodiment of the present application, showing the user holding the first driving bars and putting the feet on the pedals.

As shown in FIG. 1 to FIG. 3, a compounded fitness trainer 100 of the first preferred embodiment of the present invention includes a base 10, a sliding mount 22, a loading device 24, a damping device 36, a pair of first driving bars 46, a pair of second driving bars 48, a pair of first linkages 52, and a pair of second linkages 58.

The base 10 has a frame 12, a first upright bar 14, a second upright bar 16, a rail mount 18, and a rail 20. The frame 12 has an I shape, which has an elongated bar and two short bars transversely connected to opposite ends of the elongated bar which rest on the ground. The first upright bar 14 and the second upright bar 16 are vertically connected to a top side of the elongated bar of the frame 12 (FIG. 3). The rail mount 18 is an L-shaped bar having an upright section and a horizontal section. An end of the upright section is connected to the top side of the elongated bar of the frame 12 between the first and the second upright bars 14, 16. The rail mount 18 is bent toward the first upright bar 14, and a distal end of the first upright bar 14 is connected a bottom side of the horizontal section of the rail mount 18. The rail 20 is mounted on a top side of the horizontal section of to the rail mount 18.

The sliding mount 22 engages the rail 20 for reciprocation on the rail 20. The sliding mount 22 is connected with a seat (not shown) for a user to sit on it.

Figure 5:
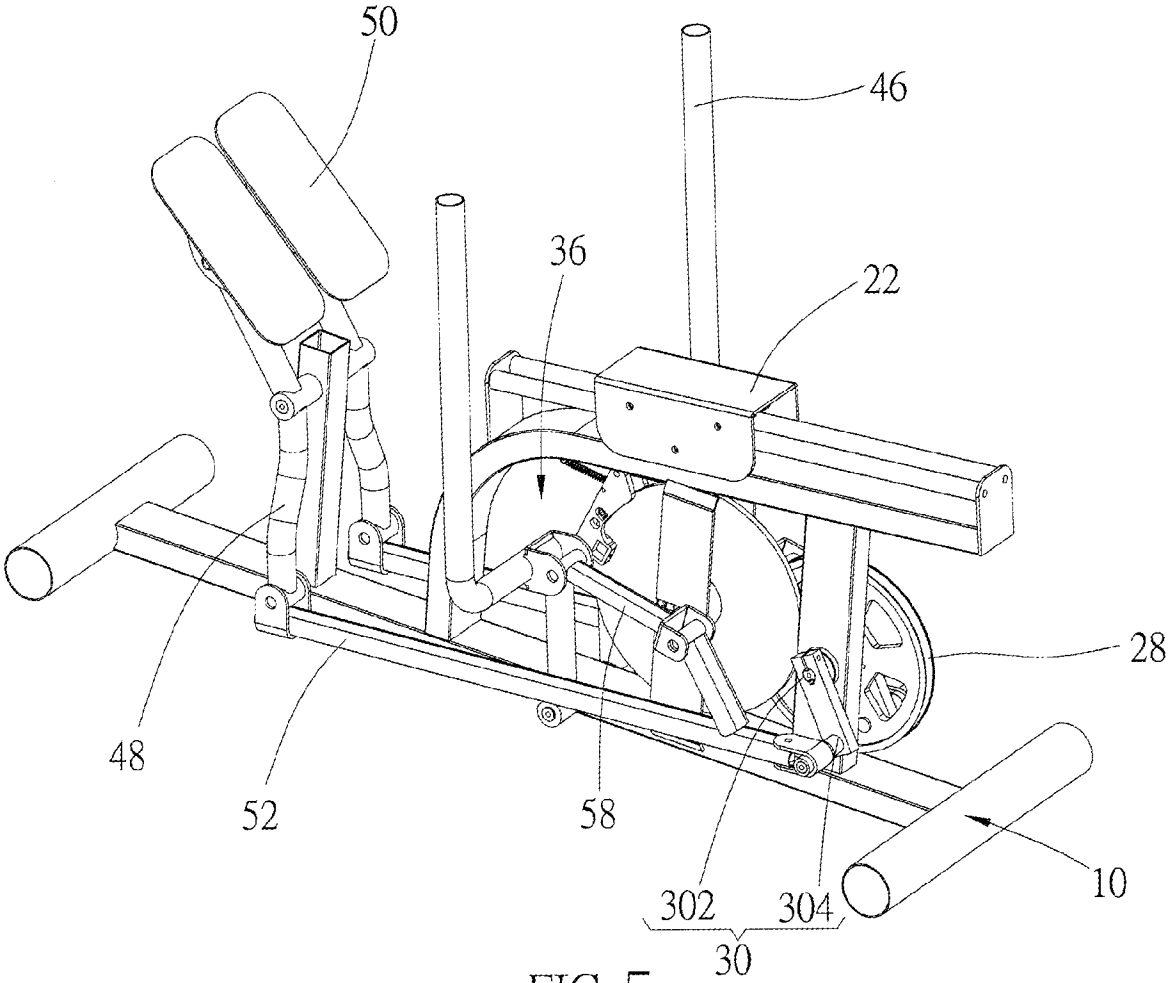
FIG. 5 is another perspective view of the first preferred embodiment of the present invention.

As shown in FIG. 2, FIG. 3, and FIG. 5, the loading device 24 includes a shaft 26, a wheel 28, and two cranks 30. The shaft 26 pivots the wheel 26 on the first upright bar 14. The cranks 30 each has a first end 302 and a second end 304. The first end 302 of the cranks 30 are connected to opposite ends of the shaft 26, and the second ends 304 are aligned with each other through the wheel 28. It means that the cranks 30 are symmetrical, they extend in the same radial direction of the wheel 28. The second end 304 of one of the cranks 30 is fixed to the wheel 28 by inserting bolt 34 into hole 281 of the wheel 28 through the crank 30.

The damping device 36 is provided at a side of the loading device 24. The damping device 36 includes flywheel 38, belt 40, and magnetic controller 42. The flywheel 38 is made of aluminum, which may generate an eddy current because of a magnet. The flywheel 38 is pivoted on the base 10, and the belt 40 is looped over the flywheel 38 and the wheel 26 to make them synchronously rotate. The magnetic controller 42 is mounted on a bottom side of the rail mount 18 and is adjacent to the flywheel 38. The magnetic controller 42 has a pair of magnets 38, which are at opposite sides of the flywheel 38. The flywheel 38 will generate an eddy current when the flywheel 38 is turning that may provide a resistance to the flywheel 38 as well as to the wheel 28.

Figure 4:
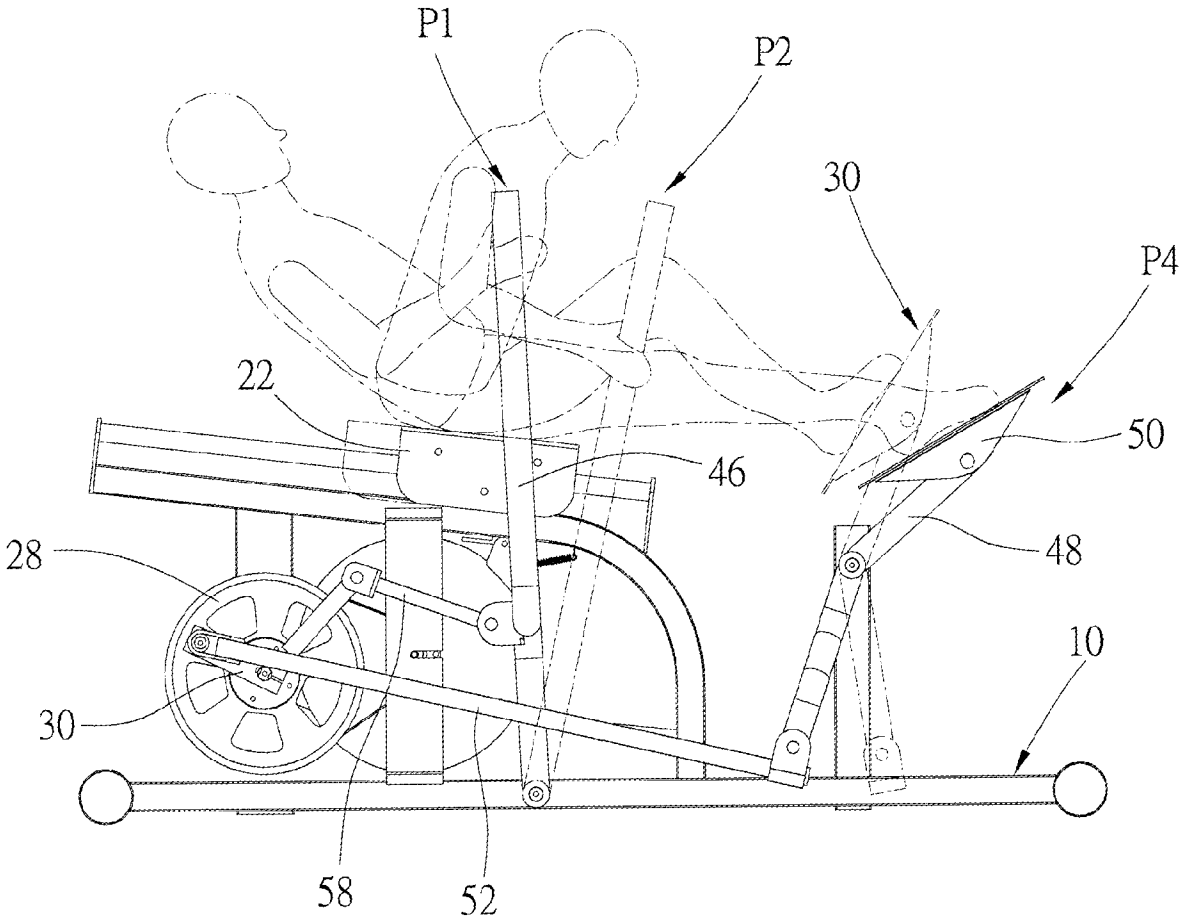
FIG. 4 is a left view of the first embodiment of the present application, showing the movements of the first driving bars and the second driving bars.

The first driving bars 46 are pivoted on the frame 12 of the base 10 to be swung between a first position P1 and a second position P2 (FIG. 4).

The second driving bars 48 respectively are pivoted on the second upright bar 16 of the base 10 to be swung between a third position P3 and a fourth position P4. Pivoting positions are at middles of the driving bars 48.

The pedals 50 respectively are pivoted on ends of the second driving bars 48, so that the pedals 50 are able to swing related to the corresponding second driving bars 48.

The first linkages 52 each has a main section 54 and a branch section 56, while the main section 54 and the branch section 56 are rigidly connected together. Opposite ends of each main section 54 respectively are pivoted on the second ends 304 of the cranks 30 and the second driving bars 48. The branch sections 56 have ends connected to outside surfaces of the corresponding main sections 54 (anywhere between ends of the main sections 54), and the main sections 54 and the branch sections 56 are not perpendicular.

The second linkages 58 have opposite ends respectively pivoted on the main sections 54 and the branch sections 56.

Above is the design of the compounded fitness trainer 100 of the first preferred embodiment of the present invention, and its operation will be described hereafter.

As shown in FIG. 3, a user sits on the seat of the compounded fitness trainer 100 with both hands holding the first driving bars 26 and both feet on the pedals 50. At this time, the user may move his/her hip on the rail 20 through the sliding mount 22. The user further may swing the first driving bars 26 between the first position P1 and the second position P2, as shown in FIG. 4, that could overcome the resistance of the damping device 36, and swing the second driving bars 48 between the third position P3 and the fourth position P4 through the second linkage 58, the loading device 24, and the first linkages 52. At this time, the user straights the legs and extends the trunk backward, and then bends the knees and flexes the trunk to approach the legs.

In such motion, the user may exert his/her legs only to swing the first driving bars 46 through the second driving bars 48, or exert his/her hands and legs to swing the first driving bars 46 and the second driving bars 48 at the same time. Different exertions will train different muscles.

When the first driving bars 46 are moved to the second positions P2, the second driving bars 48 are moved toward the first driving bars 46 and to the third positions P3. At the same time, the user crouches, and pushes the sliding mount 22 toward the first upright bar 14.

When the first driving bars 46 are moved to the first positions P1, the second driving bars 48 are moved away from the first driving bars 46 to the fourth positions P4. At this time, the user extends to move the sliding mount 22 toward the second upright bar 16.

As a result, the user repeats above motions on the compounded fitness trainer 100 to train arms, legs, abdominal muscles, and hip's muscles for total body's fitness.

In the first preferred embodiment, the compounded fitness trainer 100 allows user to extend and flex arms and legs simultaneously, which means that when arms extend, legs extend, and when arms flex, legs flex. In practice, it could have a different motion by changing the position of the loading device 24 only.

Figure 6:
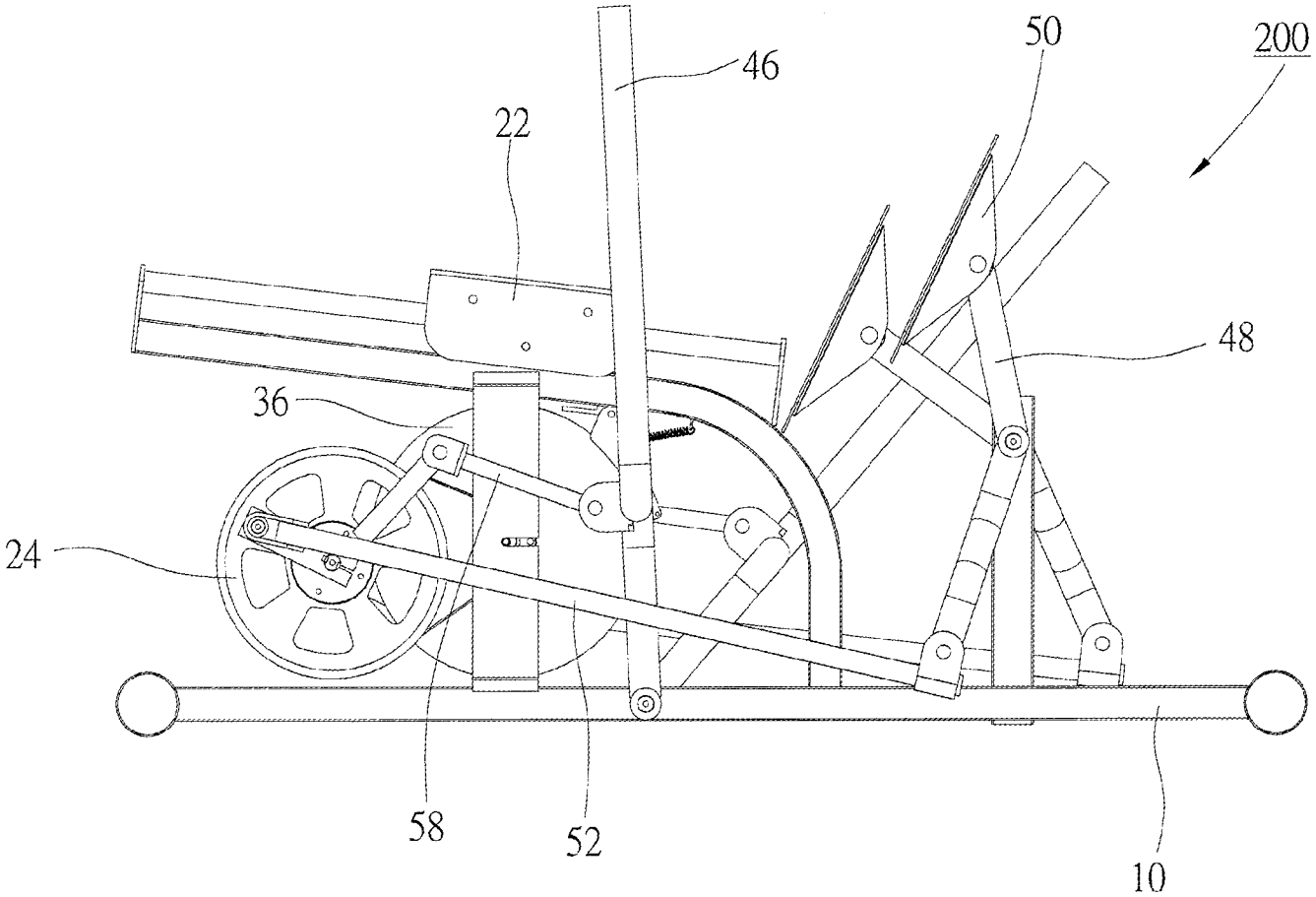
FIG. 6 is a perspective view of a second embodiment of the present application.
Figure 7:
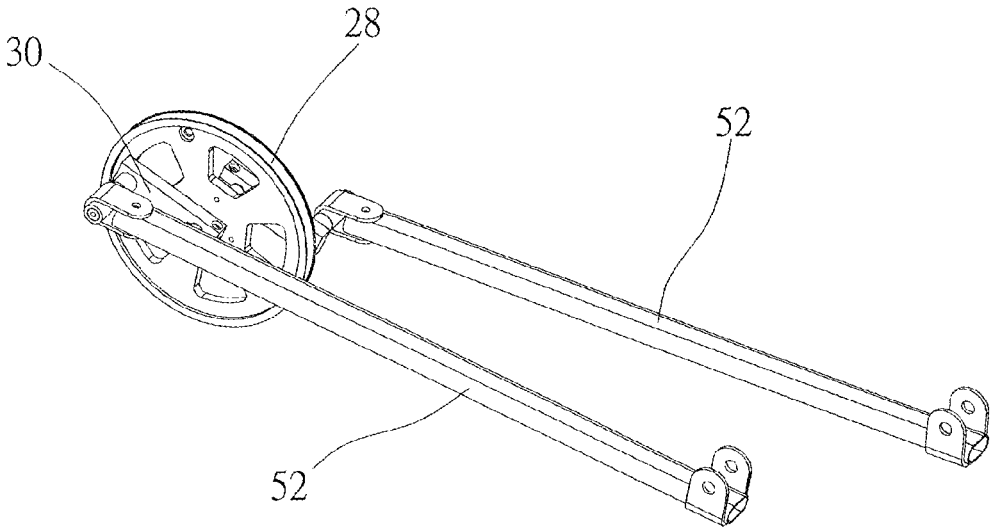
FIG. 7 is a perspective view of the wheel and the cranks of the second preferred embodiment of the present invention.
Figure 8:
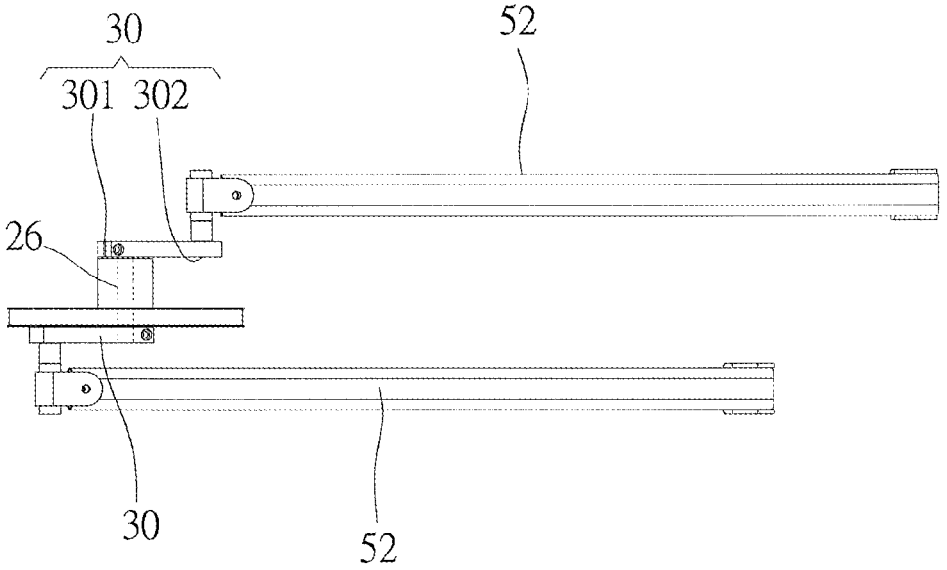
FIG. 8 is a top view of FIG. 7.
Figure 9:
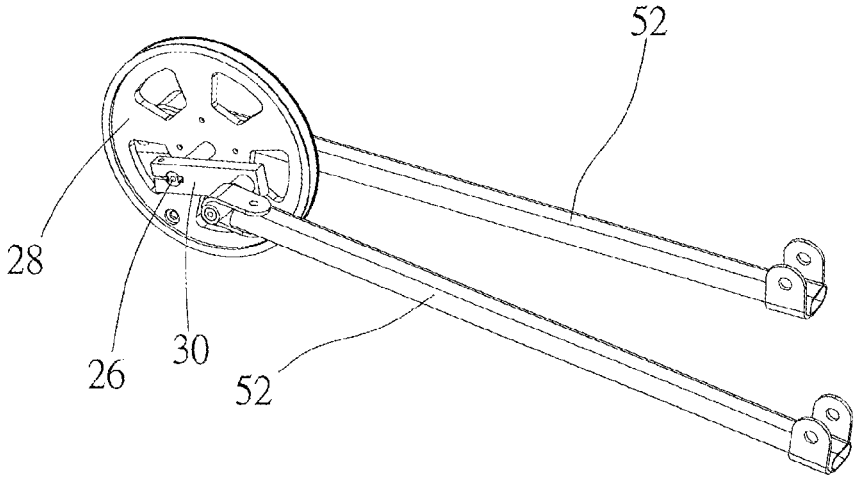
FIG. 9 is another perspective view of the wheel and the cranks of the second preferred embodiment of the present invention.
Figure 10:
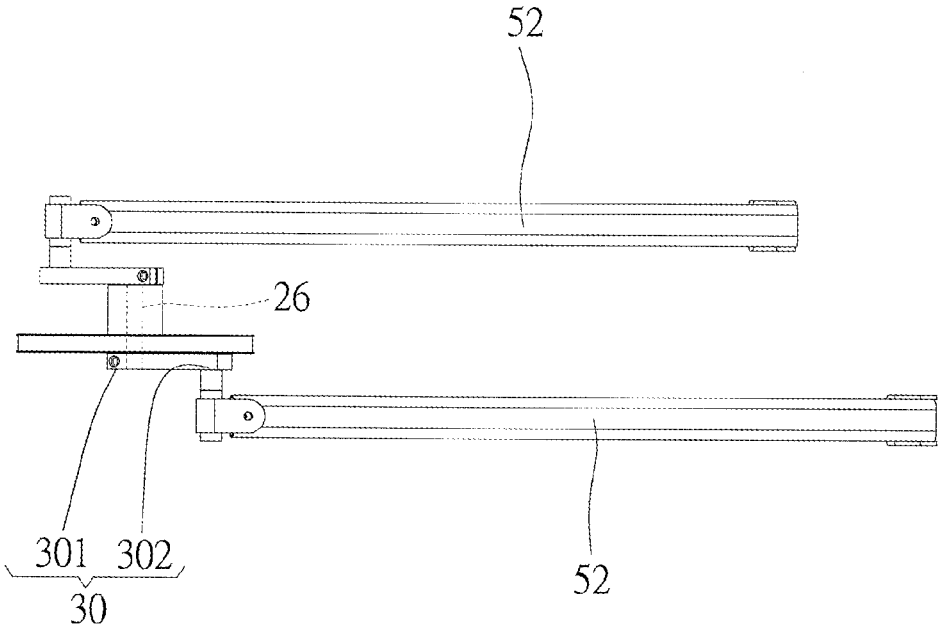
FIG. 10 is a top view of FIG. 9.

As shown in FIG. 6, a compounded fitness trainer 200 of the second preferred embodiment of the present invention, which is the same as the first embodiment, including the base 10, the sliding mount 22, the loading device 24, the damping device 36, the first driving bars 46, the second driving bars 48, the pedals 50, the first linkages 52, and the second linkages 58.

The main different part of the second preferred embodiment is the positions of two cranks 30. As shown in FIGS. from FIG. 7 to FIG. 10, the cranks 30 are at opposite sides of the wheel 28 with the first ends connected to the shaft 26, which is connected to a center of the wheel 28, and the second ends 304 not aligned with each other. In other words, orientations of the cranks 30 are opposite, the cranks 30 extends along opposite radial directions of the wheel 28.

Therefore, the first linkages 52, which respectively are pivoted on the cranks 30, will have opposite movements, one of the first linkages 52 moves forward, and the other will move backward. The same thing will happen in the first and the second driving bars 46 and 48.

As a result, when a user is doing exercise on the compounded fitness trainer 200 of the second preferred embodiment, his/her arms will move in opposite directions, and so do the legs. The motion of the second preferred embodiment is different from that of the first preferred embodiment, but they have the same function for fitness.

It must be pointed out that the embodiments described above are only some preferred embodiments of the present invention. All equivalent structures which employ the concepts disclosed in this specification and the appended claims should fall within the scope of the present invention.

What is claimed is:

1. A compounded fitness trainer, comprising:

a base;

a loading device pivoted on the base;

a pair of first driving bars pivoted on the base, each of which is moved between a first position and a second position;

a pair of second driving bars pivoted on the base, each of which is moved between a third position and a fourth position;

a pair of first linkages respectively pivoted on the second driving bars and the loading device, wherein the first linkages respectively pivoted on opposite sides of the loading device; and a pair of second linkages respectively pivoted on the first driving bars and the first linkages;

wherein the first driving bars are moved by the second driving bars when the second driving bars are moved, and the second driving bars are moved by the first driving bars when the first driving bars are moved;

wherein each of the first linkages has a main section and a branch section; each of the main sections has opposite ends pivoted on the loading device and one of the second driving bars; each of the branch sections having an end fixed to the corresponding main section, and an opposite ends pivoted on one of the first driving bars.

2. The compounded fitness trainer of claim 1, wherein the base has a frame, a first upright bar connected to the frame, and a second upright bar; both the first driving bars and the loading device are pivoted on the frame, and the second driving bars are pivoted on the second upright bar.

3. The compounded fitness trainer of claim 2, wherein the loading device has a wheel and a pair of cranks; the wheel is pivoted on the first upright bar; the wheel is between the cranks; the cranks are fixedly connected to the wheel, and pivotally connected to the first linkages.

4. The compounded fitness trainer of claim 3, wherein the cranks are connected to a center of the wheel, and extend in a radial direction of the wheel.

5. The compounded fitness trainer of claim 3, wherein the cranks are connected to a center of the wheel, and respectively extend in opposite radial directions of the wheel.

6. The compounded fitness trainer of claim 1, further comprising a sliding mount, wherein the base has a rail, on which the sliding mount is provided for reciprocation along the rail.

7. The compounded fitness trainer of claim 1, further comprising a pair of pedals respectively pivoted on ends of the second driving bars, so that the pedals are swung related to the second driving bars.

8. A compounded fitness trainer, comprising:

a base a loading device pivoted on the base;

a pair of first driving bars pivoted on the base, each of which is moved between a first position and a second position;

a pair of second driving bars pivoted on the base, each of which is moved between a third position and a fourth position;

a pair of first linkages respectively pivoted on the second driving bars and the loading device, wherein the first linkages respectively pivoted on opposite sides of the loading device; and a pair of second linkages respectively pivoted on the first driving bars and the first linkages;

wherein the first driving bars are moved by the second driving bars when the second driving bars are moved, and the second driving bars are moved by the first driving bars when the first driving bars are moved;

wherein the base has a frame, a first upright bar connected to the frame, and a second upright bar; both the first driving bars and the loading device are pivoted on the frame, and the second driving bars are pivoted on the second upright bar;

and wherein the loading device has a wheel and a pair of cranks; the wheel is pivoted on the first upright bar; the wheel is between the cranks; the cranks are fixedly connected to the wheel, and pivotally connected to the first linkages.

9. The compounded fitness trainer of claim 8, wherein the cranks are connected to a center of the wheel, and extend in a radial direction of the wheel.

10. The compounded fitness trainer of claim 8, wherein the cranks are connected to a center of the wheel, and respectively extend in opposite radial directions of the wheel.

11. A compounded fitness trainer, comprising:

a base;

a loading device pivoted on the base;

a pair of first driving bars pivoted on the base, each of which is moved between a first position and a second position;

a pair of second driving bars pivoted on the base, each of which is moved between a third position and a fourth position;

a pair of first linkages respectively pivoted on the second driving bars and the loading device, wherein the first linkages respectively pivoted on opposite sides of the loading device; and a pair of second linkages respectively pivoted on the first driving bars and the first linkages;

wherein the first driving bars are moved by the second driving bars when the second driving bars are moved, and the second driving bars are moved by the first driving bars when the first driving bars are moved;

wherein the compounded fitness trainer further comprises a sliding mount, and the base has a rail, on which the sliding mount is provided for reciprocation along the rail.

12. The compounded fitness trainer of claim 11, wherein the base has a frame, a first upright bar connected to the frame, and a second upright bar; both the first driving bars and the loading device are pivoted on the frame, and the second driving bars are pivoted on the second upright bar.

13. The compounded fitness trainer of claim 12, wherein the loading device has a wheel and a pair of cranks; the wheel is pivoted on the first upright bar; the wheel is between the cranks; the cranks are fixedly connected to the wheel, and pivotally connected to the first linkages.

14. The compounded fitness trainer of claim 13, wherein the cranks are connected to a center of the wheel, and extend in a radial direction of the wheel.

15. The compounded fitness trainer of claim 13, wherein the cranks are connected to a center of the wheel, and respectively extend in opposite radial directions of the wheel.

16. The compounded fitness trainer of claim 11, each of the first linkages has a main section and a branch section; each of the main sections has opposite ends pivoted on the loading device and one of the second driving bars; each of the branch sections having an end fixed to the corresponding main section, and an opposite ends pivoted on one of the first driving bars.

17. The compounded fitness trainer of claim 11, further comprising a pair of pedals respectively pivoted on ends of the second driving bars, so that the pedals are swung related to the second driving bars.

* * * * *